US008476848B2

(12) United States Patent
Taniguchi

(10) Patent No.: US 8,476,848 B2
(45) Date of Patent: Jul. 2, 2013

(54) LAMP LIGHTING DEVICE AND FILAMENT LAMP

(75) Inventor: Shinji Taniguchi, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 14 days.

(21) Appl. No.: 12/794,884

(22) Filed: Jun. 7, 2010

(65) Prior Publication Data

US 2010/0327784 A1 Dec. 30, 2010

(30) Foreign Application Priority Data

Jun. 25, 2009 (JP) ..... 2009-150792

(51) Int. Cl.
*H05B 39/10* (2006.01)

(52) U.S. Cl.
USPC ..... 315/363; 313/315; 313/316; 313/580; 315/291; 315/65; 315/67; 315/69; 315/74

(58) Field of Classification Search
USPC .. 313/634, 643, 580, 115, 315, 316; 315/363, 315/65, 73, 77, 291, 67, 69, 74
See application file for complete search history.

(56) References Cited

U.S. PATENT DOCUMENTS

| | | | | |
|---|---|---|---|---|
| 3,727,091 | A | 4/1973 | DeCaro | |
| 4,132,922 | A * | 1/1979 | Newton et al. | 315/73 |
| 6,127,772 | A * | 10/2000 | Carlson | 313/112 |
| 2003/0175020 | A1 | 9/2003 | Fuchs et al. | |
| 2005/0162100 | A1 * | 7/2005 | Romano et al. | 315/291 |
| 2007/0170875 | A1 | 7/2007 | Estermann | |
| 2008/0050104 | A1 | 2/2008 | Mizukawa et al. | |

FOREIGN PATENT DOCUMENTS

| | | | |
|---|---|---|---|
| JP | 2-186581 | A | 7/1990 |
| JP | 6-65172 | A | 8/1994 |
| WO | 2005/001880 | A2 | 1/2005 |
| WO | 2005/001880 | A3 | 1/2005 |

* cited by examiner

*Primary Examiner* — Douglas W Owens
*Assistant Examiner* — Jonathan Cooper
(74) *Attorney, Agent, or Firm* — Roberts Mlotkowski Safran & Cole, P.C.; David S. Safran

(57) ABSTRACT

For providing a lamp lighting device and a filament lamp wherein a wire breakage of the filament lamp can be detected without an excessive consumption of power while the device as a whole is not enlarged, a filament lamp is provided comprising a light emission tube having at least one sealing portion and in the interior of which at least one filament is arranged, internal leads connected to both ends of said filament, metal foils for power supply provided in said at least one sealing portion of the light emission tube and connected to said internal leads, and external leads connected to said metal foils for power supply; wherein a metal foil for detection is provided in said sealing portion and is connected to one of a said internal lead and a said metal foil for power supply, and an external detection lead is provided at said metal foil for detection.

5 Claims, 2 Drawing Sheets

LAMP LIGHTING DEVICE AND FILAMENT LAMP

BACKGROUND OF THE INVENTION

1. Field of Invention

The present invention relates to a lamp lighting device and a filament lamp used, for example, for the heating of semiconductor wafers.

2. Description of Related Art

Light irradiation type heating devices in semiconductor production processes are utilized over a broad range of film forming, diffusion, annealing etc., and in each of these treatments a plate-shaped object to be treated such as a semiconductor wafer can be heated rapidly. The temperature is increased to 1000° C. and more within some seconds to some ten seconds. Recently, an even faster temperature increase is desired, and the power applied to the lamp is a large electric power. This is called 'spike annealing'. The temperature is increased with a speed of more than 200° C. per second, and when the target temperature has been reached, a cooling is performed immediately. By means of this spike annealing an extremely thin diffusion layer (shallow junction) can be formed and the properties of the semiconductor element can be improved.

Devices wherein a plurality of filament lamps is arranged in parallel are utilized for such light irradiation type heating devices. Because filament lamps, although being non-contact heaters, have the ability to respond with a high speed and can heat up to a high temperature instantaneously, they are suited as light sources for the high-speed heating in semiconductor production processes. But if a part of the filament lamps installed in a light irradiation type heating device suffers a wire breakage and becomes non-lighting, the temperature distribution of the semiconductor wafer becomes uneven and there is the risk that a so-called 'slip', that is, a defect of crystal transition, occurs in the semiconductor wafer.

Therefore, it is necessary to detect wire breakages of filament lamps installed in a light irradiation type heating device at an early stage and precisely. But because the emission light of a light irradiation type heating device is extremely strong, it is not possible to detect the wire breakage of only one filament lamp even when measuring using an irradiance meter. And because the irradiated area reaches an extremely high temperature, it is also not possible to arrange irradiance monitors. Therefore, it is necessary to detect wire breakages of the individual filament lamps.

There are several methods for the detection of wire breakages of filament lamps. JP-A-6-65172 discloses a method in which a current transformer is used and a current detection of a circuit connecting a heater wire and an inverter is performed. The current transformer is also referred to as 'measuring transformer' and is able to measure the alternating current value. Because the current stops flowing when the wire of a filament lamp breaks, the wire breakage of the filament lamp can be detected by means of the current detection value of the current transformer becoming virtually zero.

In JP-A-2-186581, to detect the wire breakage of a heater, a current detector is connected in series to a circuit connecting the heater and a power source. The numeral value obtained from the current detector and a standard value are compared, and if the detection value is lower than the standard value, the judgement is made that a wire breakage of the heater has occurred.

But because of the necessity of a current transformer for each filament lamp when detecting wire breakages using a current transformer, there is the problem with light irradiation type heating devices in which a plurality of filament lamps is arranged side by side that the device itself becomes large. And as a current transformer is installed for each filament lamp, there is also the problem that the production costs increase.

When a current detector is connected in series to the power supply line connecting the power source and the filament lamps, a resistor is installed in the power supply line to detect the current and a power loss occurs. This is because a voltage is generated by the current detector, energy is consumed by the resistor of the power detector, and an excessive power consumption is caused.

SUMMARY OF THE INVENTION

The present invention was made to solve the problems mentioned above and has the object to provide a lamp lighting device and a filament lamp wherein a wire breakage of the filament lamp can be detected without an excessive consumption of power while the device as a whole is not enlarged.

The first aspect of the present invention is a filament lighting device comprising a filament lamp which is provided with a light emission tube in the interior of which a filament is arranged, internal leads connected to both ends of said filament, metal foils for the power supply provided in the sealing portions of the light emission tube and connected to said internal leads, and external leads connected to said metal foils for the power supply; and a power source connected to said external leads; and wherein a metal foil for the detection connected to a said internal lead or a said metal foil for the power supply is provided in a sealing portion of the light emission tube, an external detection lead is connected to said metal foil for the detection, and between said external detection lead and said external lead a connection is established via a voltage detector.

Further, the second aspect of the invention is a filament lamp being provided with a light emission tube in the interior of which a filament is arranged, internal leads connected to both ends of said filament, metal foils for the power supply provided in the sealing portions of the light emission tube and connected to said internal leads, and external leads connected to said metal foils for the power supply; and wherein a metal foil for the detection connected to a said internal lead or a said metal foil for the power supply is provided in a sealing portion of the light emission tube, and an external detection lead is provided at said metal foil for the detection.

In a third aspect, which is an improvement of the second aspect of the invention, the width of said metal foil for the detection is smaller than that of said metal foil for the power supply.

In a fourth aspect, which is a further improvement of the second aspect of the invention, in the interior of the light emission tube there is a plurality of filaments being supplied with power independently, for at least one filament said metal foil for the detection or a metal foil for the detection connected to said metal foil for the power supply is provided in a sealing portion of the light emission tube, and an external detection lead is provided at said metal foil for the detection.

According to the filament lamp lighting device pursuant to the first aspect of the invention and the filament lamp pursuant to the second aspect of the invention, it becomes possible with a simple structure wherein a detection lead is led out via the metal foil for the detection and a voltage detector is connected in parallel to the metal foil for the detection to detect a wire breakage of the filament lamp. Further, in case of a detection by means of a current transformer, an ammeter is also necessary in addition to the current transformer, but as in the filament lamp lighting device of the present invention a detection is possible only with the voltage detector, the number of components can be reduced and the device can be downsized. And as, furthermore, a current detector is cheaper than a current transformer, also the production costs can be kept low. And because there is no additional serial connection of a current detecting resistor to detect a wire breakage of the filament lamp, there is also no causation of a power consumption.

According to the filament lamp pursuant to the third aspect of the invention, the current flowing in the metal foil for the power supply is large while the current flowing in the metal foil for the detection being connected to the internal lead for the detection becomes very small. It is necessary to configure the metal foil for the power supply with a large width to render the electric capacity large, but the width of the metal foil for the detection can be made small. By means of making the width of the metal foil for the detection small, the additional arrangement of the metal foil for the detection becomes possible without making the shape of the sealing portion too large.

According to the filament lamp pursuant to the fourth aspect of the invention, the device as a whole can be greatly downsized by downsizing the detector, because in a filament lamp, in which a plurality of filaments is arranged, a detector to detect a wire breakage is necessary for each circuit. By means of providing a voltage detector only for the filament being most likely to suffer a wire breakage, the device can be downsized effectively.

DETAILED DESCRIPTION OF THE DRAWINGS

Figure 1:
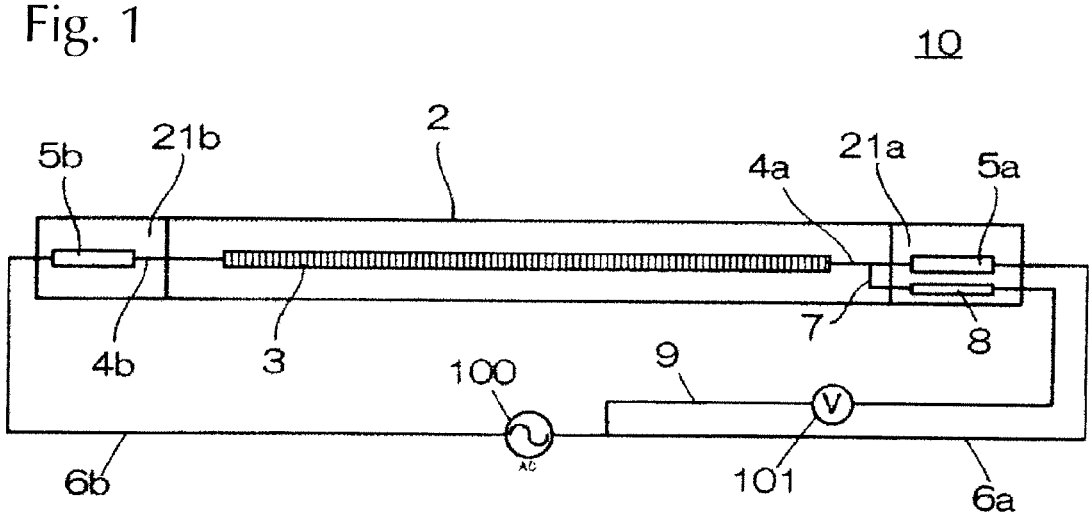
FIG. 1 is a schematic view showing the filament lamp of a first embodiment of the invention.

In the following, a first embodiment of the present invention will be explained. FIG. 1 is an explanatory sectional view showing the lamp lighting device of the first embodiment.

The lamp lighting device is made up by providing a filament lamp 10, a power source 101 to supply power to the filament lamp 10, and a voltage detector 101 connected in parallel to an external lead 6*a* of the filament lamp 10. In the filament lamp 10, an alternating current power source with a rated power of 100 W to 10000 W is connected to external leads 6*a*, 6*b* led out from both ends. The power source 100 connects the external lead 6*a* led out from one sealing portion 21*a* and the external lead 6*b* lead out from the other sealing portion 21*b* and supplies an alternating current to a filament 3.

The filament lamp 10 is configured such that a coil-shaped filament 3 is arranged in the interior of a linear tube-shaped light emission tube 2 made from quartz glass in such a way that it extends in the axial direction of the tube. Internal leads 4*a*, 4*b* made from tungsten (W) or molybdenum (Mo) are connected such that they extend from both ends of the filament 3 along the tube axis. Both ends of the light emission tube are pinch-sealed and sealing portions 21*a*, 21*b* are farmed. The interior of the light emission tube 2 is sealed air-tightly via metal foils 5*a*, 5*b* for the power supply made from molybdenum (Mo). The internal leads 4*a*, 4*b* are connected to one end of the metal foils 5*a*, 5*b* for the power supply, while external leads 6*a*, 6*b* made from copper (Cu) or nickel (Ni) are connected to the other end of the metal foils 5*a*, 5*b* for the power supply. Thus, power can be supplied from the outside of the filament lamp 10 to the filament 3 in the air-tight space in the interior.

As to the internal leads 4*a*, 4*b* arranged in the interior of the light emission tube 2, a branch is provided from the vicinity of one sealing portion 21*a* and an internal lead 7 for the detection is formed. In this one sealing portion 21*a* the metal foil 5*a* for the power supply and a metal foil 8 for the detection are buried. The internal lead 4*a* connected to the filament 3 is connected to the metal foil 5 for the power supply, while the internal lead 7 for the detection branching from the internal lead 4*a* is connected to the metal foil 8 for the detection. An external detection lead 9 extends from the metal foil 8 for the detection, and a voltage detector 101 is connected in series to the external detection lead 9. The external detection lead 9 led out from the voltage detector 101 is connected to the external lead 6*a*.

By using the internal lead 7 for the detection, the internal lead 4*a* and the external lead 6*a*, which are connected to the metal foil 5*a* for the power supply, and the internal lead 7 for the detection and the external detection lead 9, which are connected to the metal foil 8 for the detection and the voltage detector 101 become connected in parallel. Therefore, a voltage drop generated at the metal foil 5*a* for the power supply can be detected by the voltage detector 101. As the voltage detector 101 is configured such that, in general, the internal resistor becomes as large as possible, the resistance value of the branched-off circuit in which the metal foil 8 for the detection and the voltage detector 101 are connected in series becomes extremely high and it is hard for the current to flow. Therefore, it is possible to almost disregard the voltage drop generated at the voltage detector.

For this reason, the current flowing in the filament 3 mainly flows in the internal lead 6*a* without branching-off to the internal lead 7 for the detection. Thus, also the current flowing in the metal foil 5 for the power supply connected to the internal lead 6*a* becomes large while the current flowing in the metal foil 8 for the detection connected to the internal lead 7 for the detection becomes extremely small. As it is necessary to configure the width of the metal foil 5*a* for the power supply large to render the electric capacity high, a width of about 3 mm to 10 mm becomes necessary. As, on the other hand, it suffices for the metal foil 8 for the detection to be able to seal the sealing portion 21*a* air-tightly, the width can be configured smaller than that of the metal foil 5 for the power supply and even a width of about 1 mm to 2 mm is sufficient.

As the resistance value of the metal foils 5*a*, 5*b* for the power supply is extremely small with 5 mΩ to 10 mΩ in comparison to the filament 3, normally, voltage drops at the metal foils 5*a*, 5*b* for the power supply are not perceived, but this does not mean that there are no voltage drops at all. If a current of about 3 A to 20 A flows to the filament 3, most of the current flows in the internal leads 6*a*, 6*b*, and in the metal foils 5*a*, 5*b* for the power supply the voltage drops for about 15 mV to 200 mV.

Also in the circuit in which the metal foil 8 for the detection and the voltage detector 101 are connected a voltage difference similar to the degree of the voltage drop by means of the metal foil 5*a* for the power supply is generated. Because the value of the current flowing in the circuit in which the metal foil 8 for the detection and the voltage detector 101 are connected is extremely small, the degree of the voltage drop at the metal foil 8 for the detection becomes extremely small. Thus, the degree of the voltage drop generated at the metal foil 5*a* for the power supply can be detected by the voltage detector 101.

The voltage detector 101, by means of being connected in parallel to the metal foil 5*a* for the power supply, senses the presence/non-presence of a voltage drop at the metal foil 5*a* for the power supply and can detect whether a current flows in the metal foil 5*a* for the power supply or not. If no current flows in the metal foil 5*a* for the power supply, also the voltage drop at the metal foil 5*a* for the power supply disappears, and also the measurement value of the voltage detector 10 becomes almost zero. A detection than no current flows in the metal foil 5*a* for the power supply can be assessed such that a wire breakage has occurred and the filament lamp 10 should be replaced.

In the lamp lighting device of the first embodiment, a wire breakage detection for the filament lamp 10 is possible by means of the simple configuration of leading a lead 9 for the detection to the outside via the metal foil 8 for the detection and connecting the voltage detector 101 in parallel to the metal foil 5*a* for the power supply. The voltage measured by the voltage detector 101, although having the degree of the voltage drop at the metal foil 5*a* for the power supply, is extremely small with about 15 mV to 200 mV. For the detection by means of a current transformer, an ammeter is necessary in addition to the current transformer, but as with the lamp lighting device of the present invention a detection is possible only with the voltage detector 101, the number of components can be reduced and the device can be downsized. Furthermore, as the voltage detector 101 is cheaper than a current transformer, it is also possible to keep the production costs low.

Because with the voltage detector 101 there is no additional serial connection of a current detecting resistor to detect a wire breakage of the filament lamp 10, there is also no causation of an excessive power consumption.

Figure 2A:
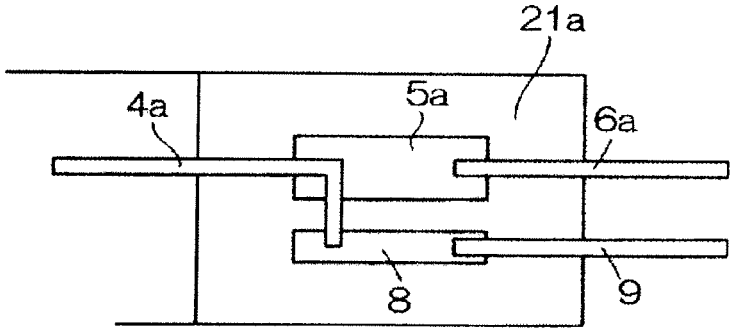
FIG. 2 is a schematic view showing modifications of the filament lamp of the first embodiment.
Figure 2B:
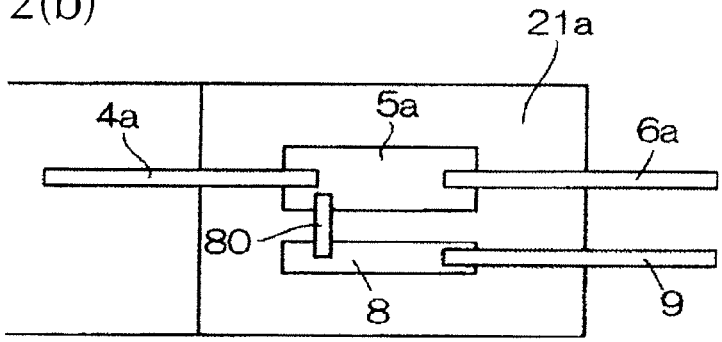

Next, modifications of the first embodiment will be explained. FIG. 2 is an enlarged view showing other examples, with regard to the first embodiment, for the connection of the metal foil 8 for the detection being connected in parallel to the metal foil 5*a* for the power supply.

As shown in FIG. 2(*a*), the tip end of the internal lead 4*a* being connected to the metal foil 5*a* for the power supply is formed such that it is bent to an L-shape, and is connected to both the metal foil 5*a* for the power supply and the metal foil 8 for the detection. By means of energizing both the metal foil 5 for the power supply and the metal foil 8 for the detection only by the internal lead 4*a* the voltage detector being connected to the external detection lead 9 led out from the metal foil 8 for the detection can also be connected in parallel to the metal foil 5 for the power supply.

Or, as shown in FIG. 2(*b*), a metal foil 5*a*, to which the internal lead 4*a* and the external lead 6*a* are connected, and a metal foil 8, to which the external detection lead 9 is connected, are prepared and the metal foil 5*a* for the power supply and the metal foil 8 for the detection are electrically continuous by means of a connection lead 80. Also by means of such a connection, the voltage meter connected to the external detection lead 9 led out from the metal foil 8 for the detection can be connected in parallel to the metal foil 5 for the power supply.

Figure 3:
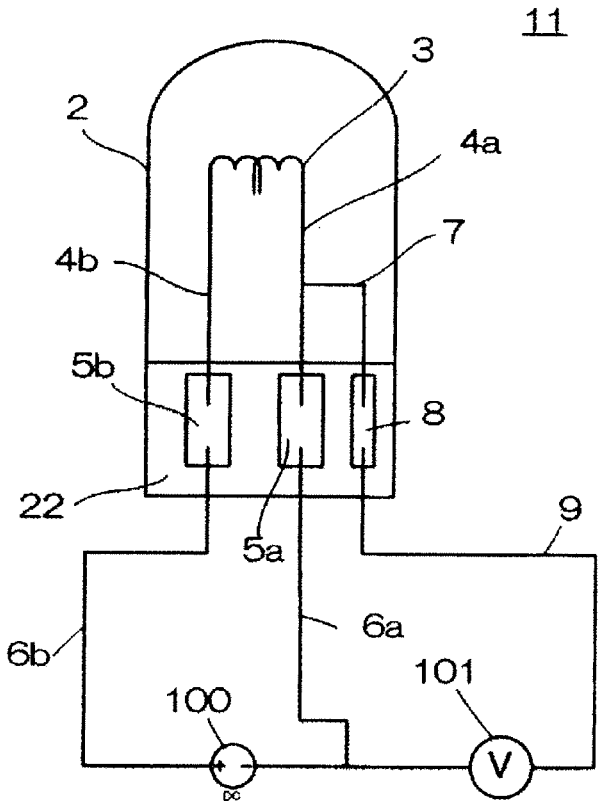
FIG. 3 is a schematic view showing the filament lamp of a second embodiment of the invention.

Next, a second embodiment will be explained. FIG. 3 is an explanatory sectional view showing the lamp lighting device of the second embodiment.

The filament lamp 10 of the first embodiment is a so-called 'double end filament lamp' wherein sealing portions 21*a*, 21*b* are formed at both ends of the light emission tube 2, but the filament lamp 11 of the second embodiment is a so-called 'single end filament lamp' wherein a sealing portion 22 is formed at one end of the light emission tube 2. Internal leads 4*a*, 4*b* connected to both ends of the filament 3 extend in parallel in the same direction towards the sealing portion 22 and are connected to metal foils 5*a*, 5*b* for the power supply buried in the sealing portion 22. A power source 100 having a rated power of 10 W to 5000 W is connected to outer leads 6*a*, 6*b*, and the filament 3 is supplied with a direct current.

At one internal lead 4*a*, a branch is provided from the vicinity of the sealing portion 22 and an internal lead 7 for the detection is formed. In the sealing portion 22, in addition to the metal foils 5*a*, 5*b* for the power supply a metal foil 8 for the detection is buried, and the internal lead 7 for the detection is connected to the metal foil 8 for the detection. An external detection lead 9 extends from the metal foil 8 for the detection, and a voltage detector 101 is connected in series to the external detection lead 9. The external detection lead 9 led out from the voltage detector 101 is connected to the external lead 6*a*.

As the voltage detector 101 is connected in parallel to the metal foil 5*a* for the power supply, a voltage difference similar to the degree of the voltage drop by means of the metal foil 5*a* for the power supply can be detected by the voltage detector 101. If no current flows in the metal foil 5*a* for the power supply, also the voltage drop at the metal foil 5*a* for the power supply disappears, and also the measurement value of the voltage detector 10 becomes almost zero. Thus, if by means of the measurement value of the voltage detector 101 it is detected that there is no voltage drop at the metal foil 5*a* for the power supply, no current flows in the metal foil 5*a* for the power supply, and this fact is assessed such that a wire breakage has occurred and the filament lamp 11 should be replaced.

Figure 4:
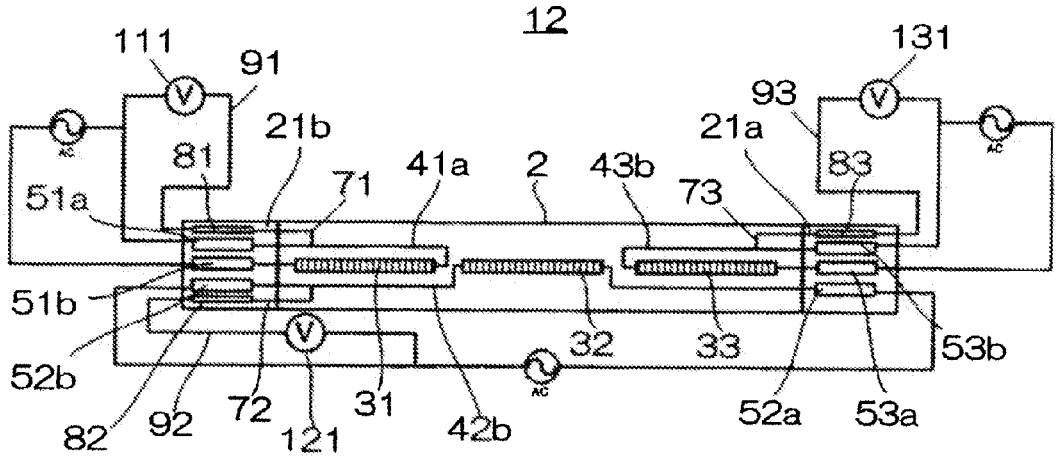
FIG. 4 is a schematic view showing the filament lamp of a third embodiment of the invention.

Next, a third embodiment will be explained. FIG. 4 is an explanatory sectional view showing the lamp lighting device of the third embodiment.

In the filament lamp 10 of the first embodiment, only one filament 3 is arranged in the interior of the light emission tube, but in the filament lamp 12 of the third embodiment three filaments 31, 32, 33 which can be fed independently are arranged in the interior of the light emission tube 2. The internal leads connected to both ends of the filaments 31, 33 being arranged closest to the sealing portions 3*a*, 3*b* extend in the direction of the same sealing portion respectively, while the internal leads connected to the filament 32 positioned in the middle part extend in the directions of the sealing portions 21*a*, 21*b* at both ends and are held such that they are connected to the metal foils 52*a*, 52*b* for the power supply at said sealing portions 21*a*, 21*b*.

At the inner leads 41*a*, 42*b*, 43*b* connected to the filaments 31, 32, 33 respectively, a branch is provided from the vicinity of the sealing portion 21*a*, 21*b* and inner leads 71, 72, 73 for the detection are formed. In the sealing portions 21*a*, 21*b*, metal foils 81, 82, 83 for the detection are buried in addition to the metal foils 51*a*, 51*b*, 52*a*, 52*b*, 53*a*, 53*b* for the power supply such that in the one sealing portion 21*a* three metal foils 52*a*, 53*a*, 53*b* for the power supply and one metal foil 83 for the detection are buried while in the other sealing portion 21*b* three metal foils 51*a*, 51*b*, 52*b* for the power supply and two metal foils 81, 82 for the detection are buried. At the one sealing portion 21*a* one internal lead 73 for the detection is connected to the metal foil 83 for the detection while at the other sealing portion 21*b* two internal leads 71, 72 for the detection are connected to the metal foils 81, 82 for the detection.

External detection leads 91, 92, 93 extend respectively from the metal foils 81, 82, 83 for the detection, and voltage detectors 111, 121, 131 are connected in series to each external detection lead 91, 92, 93. The external detection lead 93 extending from the one sealing portion 21*a* detects a wire breakage of the filament 33 positioned close to the one sealing portion 21*a*. The two external detection leads 91, 92 extending from the other sealing portion 21*b* detect a wire breakage of the filament 31 positioned close to the other sealing portion 21*b* and a wire breakage of the filament 32 positioned in the middle part respectively.

Because the voltage detectors 111, 121, 131 are connected in parallel to the metal foils 51*a*, 52*b*, 53*b* for the power supply feeding the filaments 31, 32, 33, it can be detected by means of the measurement values of the voltage detectors 111, 121, 131 if any of the filaments 31, 32, 33 arranged in the interior of the light emission tube 2 has suffered a wire breakage. As with the filament lamp 12, wherein a plurality of independently fed filaments 31, 32, 33 is arranged in the interior of the light emission tube 2, a detector to sense a wire breakage becomes necessary for each circuit, the device as a whole can be made significantly smaller by downsizing the detectors.

If it is known from experience etc. that a certain filament among the filaments 31, 32, 33 being arranged in the interior of the light emission tube 2 is likely to be subjected to a load and is likely to break down, a provision of a voltage detector only for the filament most likely to suffer a wire break is effective with respect to downsizing the device.

What is claimed is:

1. A filament lamp lighting device wherein a plurality of filament lamps is arranged, each comprising a filament lamp having a light emission tube having with at least one sealing portion and in the interior of which at least one filament is arranged, a pair of internal leads, each of which is connected to a respective end of said at least one filament, metal power supply foils provided in said at least one sealing portion of the light emission tube and connected to said internal leads, and a pair of external power supply leads connected to said metal power supply foils for supplying of power to said at least one filament via said foils and internal leads; and a power source connected to said external power supply leads;

wherein at least one metal foil for detection is provided in said sealing portion and is connected to one of a said internal lead and a said metal power supply foil, and wherein an external detection lead is connected to said at least one metal foil for detection, and wherein, between said external detection lead and said external power supply lead, a connection is established via a voltage detector connected in a manner for detecting breakage of a filament wire by detecting a voltage drop generated at the metal power supply foil.

2. The filament lamp lighting device according to claim 1, wherein a width of said metal foil for detection is smaller than that of said metal power supply foils for power supply.

3. The filament lamp lighting device according to claim 1, wherein a plurality of filaments are arranged in the interior of the light emission tube with respective internal leads, metal power supply foils and external leads for being supplied with power independently of each other, and wherein said at least one metal foil for detection is connected to a respective one of one of the internal leads and a respective one of the metal foils.

4. The filament lamp lighting device according to claim 3, wherein a respective metal foil for detection and external detection lead is provided for each of the filaments.

5. A filament lamp lighting device according to claim 1, wherein the connection of said voltage detector is in parallel to said metal power supply foil.

* * * * *